US008820005B2

(12) United States Patent
Hovsepian

(10) Patent No.: US 8,820,005 B2
(45) Date of Patent: Sep. 2, 2014

(54) PORTABLE SHELTER STRUCTURE AND MANUFACTURING PROCESS

(76) Inventor: Tina Hovsepian, Glendale, CA (US)

( * ) Notice: Subject to any disclaimer, the term of this patent is extended or adjusted under 35 U.S.C. 154(b) by 6 days.

(21) Appl. No.: 13/475,826

(22) Filed: May 18, 2012

(65) Prior Publication Data

US 2012/0291364 A1 Nov. 22, 2012

Related U.S. Application Data

(60) Provisional application No. 61/519,317, filed on May 20, 2011.

(51) Int. Cl.

| | |
|---|---|
| ***E04B 7/12*** | (2006.01) |
| ***E04B 1/12*** | (2006.01) |
| ***E04H 15/18*** | (2006.01) |
| ***E04B 1/32*** | (2006.01) |
| ***E04H 15/36*** | (2006.01) |

(52) U.S. Cl.

USPC ..... 52/79.5; 52/63; 52/18; 135/97; 135/128

(58) Field of Classification Search

CPC ..... E04B 1/32; E04B 1/3205; E04B 1/343; E04B 1/34357; E04B 1/34378; E04B 1/3445; E04B 1/107; E04B 2001/32; E04B 2001/3294; E04B 2001/343; E04H 15/00; E04H 15/18

USPC ..... 52/1, 18, 63, 67, 79.5, 222; 135/95, 97, 135/128, 157

See application file for complete search history.

(56) References Cited

U.S. PATENT DOCUMENTS

| | | | | |
|---|---|---|---|---|
| 3,143,194 | A * | 8/1964 | Hart | 52/561 |
| 3,629,982 | A * | 12/1971 | Ballay et al. | 52/69 |
| 3,759,277 | A * | 9/1973 | Glade | 135/95 |
| 3,854,266 | A * | 12/1974 | Salas | 52/745.14 |
| 4,359,842 | A * | 11/1982 | Hooker | 52/18 |
| 4,809,726 | A * | 3/1989 | Gillis | 135/136 |
| 5,234,727 | A * | 8/1993 | Hoberman | 428/12 |
| 5,331,778 | A | 7/1994 | Mazpule et al. | |
| 5,555,681 | A | 9/1996 | Cawthon | |
| 6,151,841 | A | 11/2000 | Green | |
| 6,233,880 | B1 * | 5/2001 | Sogame et al. | 52/79.5 |
| 6,334,278 | B1 | 1/2002 | Arnold | |
| 6,766,619 | B1 | 7/2004 | Franz | |
| 6,892,744 | B2 * | 5/2005 | Feldpausch et al. | 135/146 |
| 7,874,304 | B2 * | 1/2011 | Ostrowski | 135/148 |
| 2001/0035203 | A1 * | 11/2001 | Clee et al. | 135/87 |
| 2003/0074845 | A1 * | 4/2003 | Sample et al. | 52/63 |
| 2004/0154235 | A1 | 8/2004 | Johnson | |
| 2007/0175162 | A1 * | 8/2007 | Beyer | 52/641 |
| 2009/0000213 | A1 | 1/2009 | Coopman | |
| 2009/0056237 | A1 | 3/2009 | Dickinson et al. | |
| 2010/0139727 | A1 * | 6/2010 | Vondohlen et al. | 135/143 |
| 2011/0094554 | A1 * | 4/2011 | Ostrowski | 135/128 |

* cited by examiner

*Primary Examiner* — Ryan Kwiecinski

(74) *Attorney, Agent, or Firm* — Knobbe, Martens, Olson & Bear, LLP

(57) ABSTRACT

A portable shelter is configured to be quickly and easily deployed and configured for use as a temporary shelter, such as during disaster situations. In one embodiment, the shelter includes an elongate body having a first and second body portions, the first and second body portions are configured to be folded according to different first and second folding pattern. The elongate body is collapsible and expandable between a first, expanded configuration and a second, collapsed configuration. The elongate body has a longitudinal length extending from the elongate body's first end to its second, opposite end. In the first, expanded configuration the second body is substantially flat along the longitudinal length and the first body defines a substantially c-shaped cavity that extends along the longitudinal length. In the second, collapsed configuration the second body is folded and compressed along the longitudinal length such that the second body extends into the c-shaped cavity.

15 Claims, 16 Drawing Sheets

PORTABLE SHELTER STRUCTURE AND MANUFACTURING PROCESS

CROSS-REFERENCE TO RELATED APPLICATIONS

This application claims priority to U.S. Application No. 61/519,317, filed May 20, 2011, titled PORTABLE SHELTER STRUCTURE AND PROCESS, the entire contents of which are incorporated by reference herein and made a part of this specification.

BACKGROUND

Conventional portable shelter structures such as collapsible tents or canopies usually have fabric structures supported by a rigid frame structure. The rigid frame structure may be formed from multiple, interconnected metallic or plastic tubes. Each time such a portable structure is used, the rigid frame and fabric structures must be assembled and combined together. In order to move or store the structure, the frame is disassembled and the fabric structure is folded or collapsed to a compact size. If the structure is to be used again, the frame and fabric structures must be reassembled to form the shelter structure. Such recurring assembly and disassembly is inconvenient and time consuming.

In addition, the assembly process can be difficult to perform. Many people, such as children and persons with physical limitations, may not be able to assemble the shelter structure. In situations where an easy-to-assembly shelter is required immediately, such as in an area that has suffered a natural disaster, lack of such shelter could have further disastrous consequences.

SUMMARY

Accordingly, there is a need for a lightweight portable shelter that can be quickly deployed with minimal setup and assembly time. Further there is a need for an environmentally friendly temporary shelter that is low-cost and can be easily deployed and utilized. Such a shelter could be used in many situations, including but not limited to, disaster situations, temporary shelters for homeless people, portable storage units, a toy structure or playhouse, etc.

In one embodiment, a portable shelter comprises a unitary body having first and second body portions. The first body portion is configured according to a first folding pattern and the second body portion is configured according to a second folding pattern. The unitary body is adapted to change between a first configuration and a second configuration. The unitary body has a longitudinal length extending from one end to the opposite end. In the first configuration the second body is substantially flat and the first body forms a cavity between the first body and the second body. In the second configuration the second body is folded such that it extends into the cavity and the longitudinal length is greater in the first configuration than in the second configuration. The shelter can be configured to expand and contract between the first and second configuration substantially along a single axis. The volume of the cavity is substantially larger in the first configuration than in the second configuration.

In some embodiments, the first and second body portions are separable. The first and second body portions may be integrally bound. The first and second body portions may be formed from separate pieces of material. In some embodiments, such as large support structures, the top body portion may be formed of a plurality of pieces of material. The shelter may be manufactured using cardboard.

In some embodiments, the first body portion may have a plurality of connecting members and the second body portion may have a plurality of connecting members. The connecting members of the first body portion are coupled to the connecting members of the second body portion.

In some embodiments, the portable shelter may have additional structural support members coupled to the first body portion. The unitary body may have coating to protect the occupants from the environment such as waterproof and fireproof coatings. In other embodiments the shelter may have door-like structures on one or both ends of the shelter. The door structures are coupled to the unitary body and have folding patterns that are different than the first and second body portions. The door structures are configured to cover the openings of the cavity.

In another embodiment of a portable shelter, the shelter has a unitary body comprising first and second body portions. The first body portion is configured according to a first folding pattern and the second body portion is configured according to a second folding pattern. The first body has a first plurality of planar faces and the second body has a second plurality of planar faces. The unitary body is configured to change between a first configuration and a second configuration. In the first configuration the second body is substantially flat and the first body forms a cavity between the first body and the second body. In the second configuration the first plurality of planar faces are configured to be substantially parallel to a first plane and the second plurality of planar faces are configured to be substantially parallel the first plane. The first and second pluralities of planar faces may be substantially triangular.

An embodiment of a method of manufacturing a shelter comprises: providing a first body; forming a first folding pattern on the first body; folding the first body in accordance with the first folding pattern, such that the first body has a first plurality of planar faces; and manipulating the first body into a condensed position, wherein the first body is compressed primarily along a single axis and wherein the first plurality of planar faces are configured to be on substantially parallel planes relative to each other.

In some embodiments the method also includes providing a second body; forming a second folding pattern on the second body; and folding the second body in accordance with the second folding pattern, such that the second body has a second plurality of planar faces. The method may also include coupling the first body and the second body to form a shelter assembly.

Additional advantages and features of the invention will become apparent from the description that follows.

DETAILED DESCRIPTION

Figure 1:
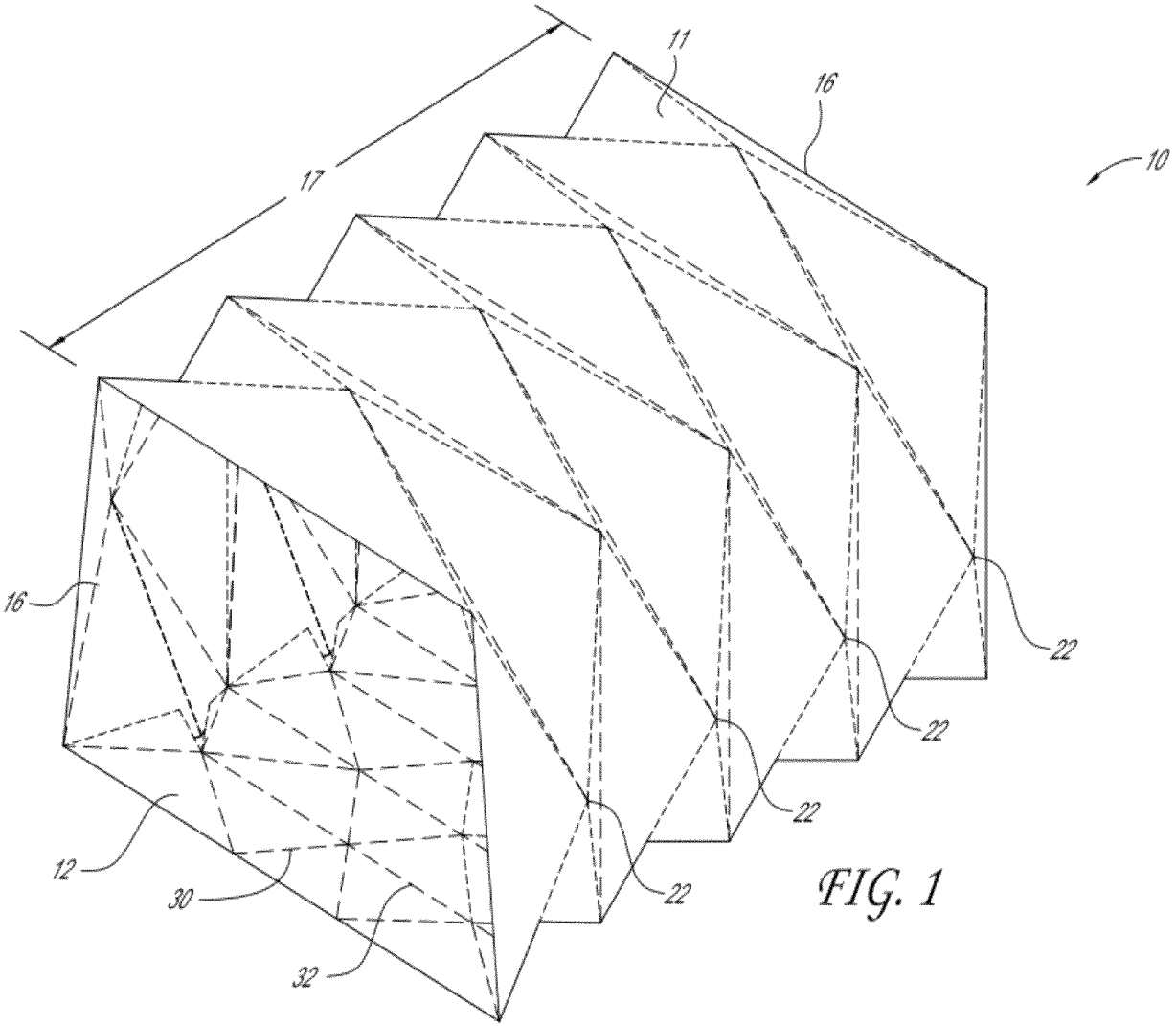
FIG. 1 is a perspective view of an embodiment of a portable shelter in an expanded configuration.
Figure 2:
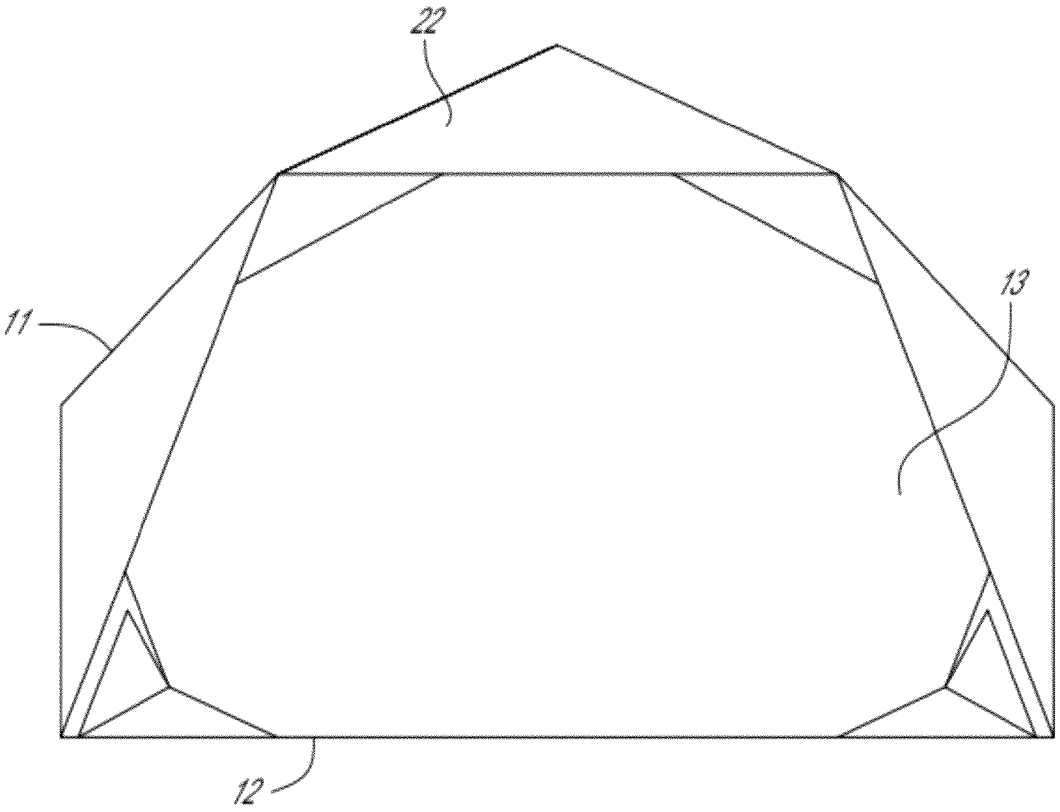
FIG. 2 is a front view of the embodiment of the portable shelter of FIG. 1.
Figure 3:
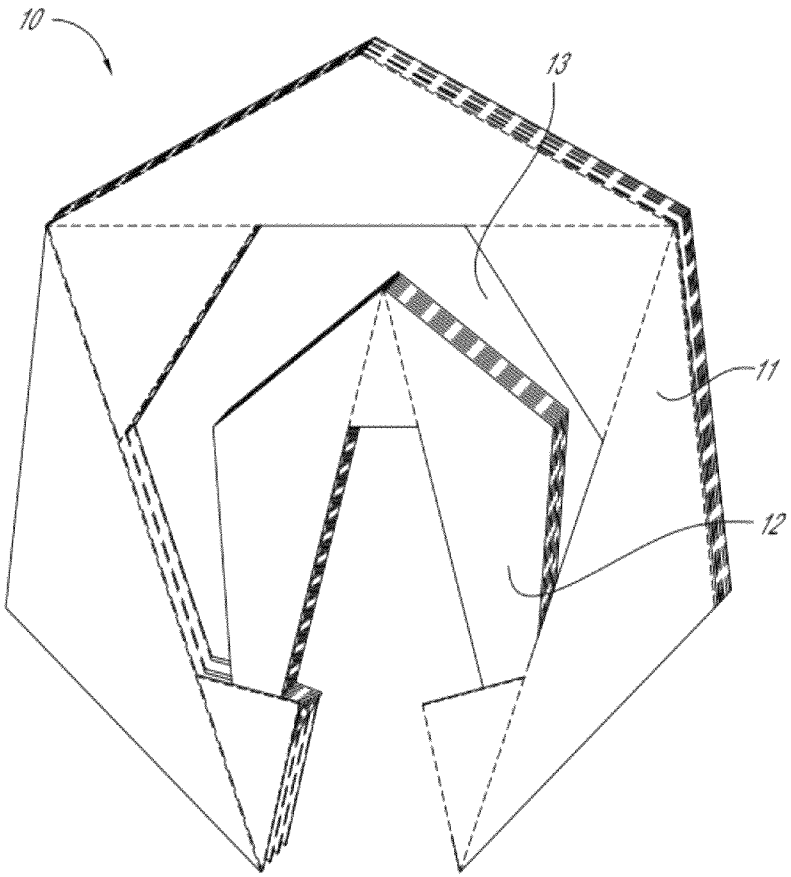
FIG. 3 is a perspective view of the embodiment of a portable shelter of FIG. 1 in a collapsed configuration.
Figure 4:
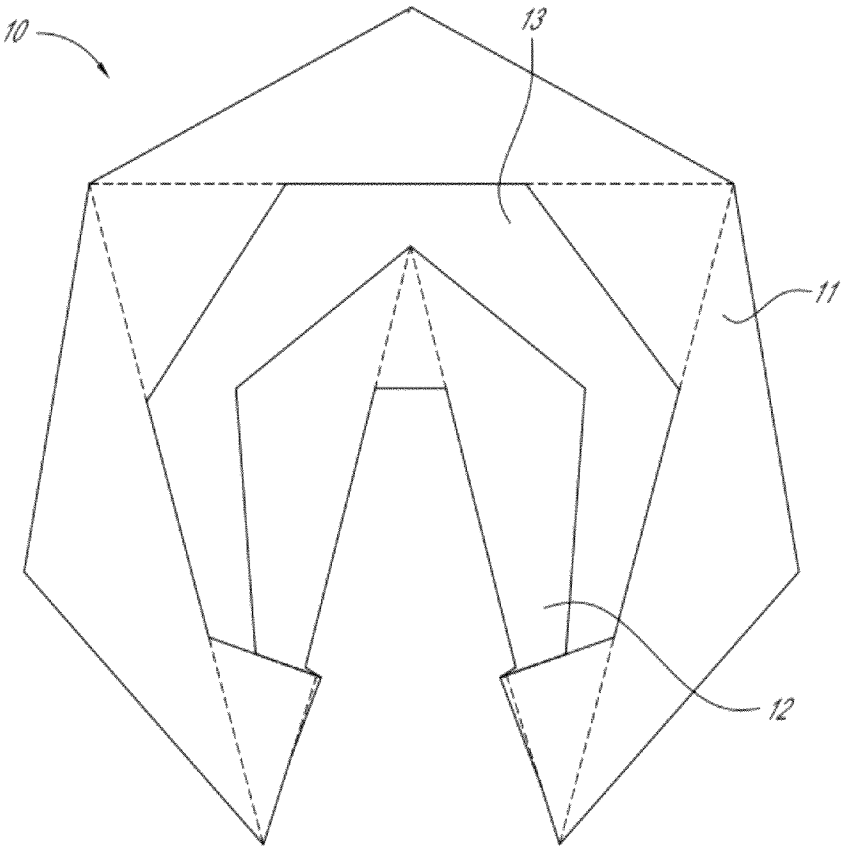
FIG. 4 is a front view of the embodiment of the portable shelter of FIG. 1 in a collapsed configuration.

FIGS. 1 through 4 illustrate one embodiment of a portable shelter 10. The portable shelter 10 comprises a top body 11 and a bottom body 12, which together define an internal cavity 13. The portable shelter 10 includes accordion-like, foldable wall structures that are configured to expand and compress in an alternating, zig-zag sequence. The shelter 10 expands and contracts as a single unit or unitary body, such that the top body 11 and the bottom body 12 contract and expand together. When the portable shelter 10 is expanded, the shelter 10 is formed in a first, expanded, configuration. The expanded configuration of the portable shelter 10 is illustrated in FIGS. 1-2. When the portable shelter 10 is fully compressed or collapsed, the shelter 10 is formed in a second, collapsed, configuration. The collapsed configuration is illustrated in FIGS. 3-4.

In the illustrated embodiment, the top body or roof section 11 of the shelter 10 is formed by four top section units 22 and the bottom body or floor section 12 is formed by four bottom section units 32. The top sections 22 and the bottom section units 32 can be integrally bonded to form a unitary body. The shelter 10 has a length 17. The shelter cavity 13 extends the length 17 of the shelter 10 and has two quadrilateral openings at the shelter's two free ends 16. The shelter 10 can be formed by any equal number of top and bottom section units 22, 32 to adjust the length 17 of the shelter 10 while having the same height and width. The height and width of the cavity 13 is defined by the size of the top body 11 and the bottom body 12. The number of top and bottom section units 22, 32 defines the length 17. The series of connecting top and bottom section members 22, 32 form a one-piece or unitary member and are configured to be guided to move in a concurrent manner. In one embodiment, the unitary body expands to the first configuration and collapses to be in the second configuration without the need for additional tools or assembly.

The top body or roof section 11 forms the top and lateral sides of the shelter 10. The bottom body or floor section 12 forms the bottom of shelter 10. The shape of the top body 11 of the shelter 10 is substantially defined by a folding pattern 20 of the top body 11. The folding pattern 20 divides the top body 11 into a plurality of planar sections separated by mountain and valley folds along the lines of the folding pattern 20. The shape of the bottom body 12 of the shelter 10 is substantially defined by a folding pattern 30 of the bottom body 12. The folding pattern 30 divides the bottom body 12 into a plurality of planar sections separated by mountain and valley folds along the lines of the folding pattern 20. In one embodiment, the planar sections of the top and bottom sections 11, 12 are triangular.

The profile of the top body 11 and bottom body 12 are different in the first and second configurations as illustrated in FIGS. 2 and 4, respectively. As the shelter 10 is expanded from the second configuration to the first configuration, the height of the shelter 10 gradually decreases and the width of the shelter 10 gradually increases. In the first, expanded configuration (see FIG. 2) the shelter 10 is elongated and the longitudinal length 17 of the shelter 10 is increased or maximized. In this configuration the shape of top body is substantially defined by the folding pattern 20, whereas the bottom body 12 is configured to be substantially flat, as shown in FIGS. 1 and 2. In the collapsed configuration (see FIG. 4) the shelter 10 is in a flattened and compact state. The top body 11 and bottom body 12 are fully compressed and the longitudinal length 17 of the shelter 10 is reduced or minimized. The bottom body 12 folds up to fit substantially within the internal cavity 13 and between the sides of the top body 11, such that the width of the bottom body 12 is less than the width of the top body 11 and the height of the bottom body 12 is less than the height of the top body 11. As such, the bottom body 12 is enclosed by the top body 11 to form a compact structure, as shown in FIGS. 3 and 4.

When in the collapsed configuration, the plurality of planar faces of the top body 11 and the bottom body 12 are aligned on substantially parallel planes, as illustrated in FIGS. 3 and 4. The planar faces may not be exactly aligned on parallel planes due to fold angles, materials, and overlap of the planar sections. In one embodiment, the planar faces are within 10° of being parallel to each other. In some embodiments the top body 11 and the bottom body 12 are coupled together at an angle that is less than or equal to 90°.

In one embodiment, the volume of the internal cavity 13 of the shelter 10 substantially changes as the shelter expands from the collapsed configuration to the expanded configuration, similar to the operation of an accordion. For example, in one embodiment the shelter measures two feet in length 17 in the collapsed configuration and forty feet in length 17 in the expanded configuration, which represents an increase of volume of the shelter by approximately 2,000%. In one embodiment the opening of the shelter measures four feet wide by two and a half feet in height. Preferably a shelter for a single occupant measure five to six feet in length.

The shelter 10 can function as a self-supporting, standalone unit. The top body 11 and the bottom body 12 are coupled together and the assembled shelter 10 functions as a unitary body, such that the top body 11 and the bottom body 12 contract and expand together substantially along a single axis. The top body 11 and bottom body 12 do not need to be decoupled for the shelter 10 to change from the first configuration to the second configuration or vice-versa. In the collapsed configuration the shelter 10 forms a substantially flat and compact unit for transportation and storage. If necessary, the shelter 10 may be disassembled by decoupling the top body 11 from the bottom body 12. In some embodiments, the top body 11 and the bottom body 12 may be permanently coupled together. The top body 11 and bottom body 12 may be assembled together using hook and loop fasteners, button fasteners, adhesive tapes, adhesive glues, or other appropriate coupling materials. Hook and loop fasteners allow the components to be coupled and decoupled without damaging the components of the shelter. Hook and loop fasteners also allow for the components to be quickly coupled together during assembly of the structure.

In some embodiments the shelter 10 may be assembled and manipulated (e.g., contracted and expanded) without the use of tools or additional equipment. For example, a shelter 10 for a single person can be manipulated by a single person without the help of additional people. In the collapsed configuration, the shelter 10 is compact and light enough for a person to carry and in the expanded configuration the shelter 10 can surround and shelter a person that is lying down.

The shelter 10 may be formed from cardboard, plastic, or other sheet-like materials with sufficient rigidity to maintain the shape and structural integrity of the shelter. Cardboard is often used because it is light weight, relatively low cost, recyclable, and has sufficient rigidity to maintain the structural integrity of the shelter. In addition, cardboard has internal baffles that help to increase the rigidity of the structure. The shelter 10 material is generally capable of folding and unfolding multiple times while maintaining the structural integrity of the material. The shelter may be formed from a wide range of paper and cardboard materials, such as cardboard, containerboard, cartonboard, linerboard, multiwall paper, paperboard, and other paper products. The shelter 10 may be manufactured using paper that is puncture, tear, and/or water resistant.

In the illustrated embodiment, the top body 11 and bottom body 12 are each formed from a single piece of material. In some embodiments the top body 11 and bottom body 12 may be formed from a plurality of sheets of material. For large shelters multiple pieces of material may be coupled together to form the top body 11 or bottom body 12. More than one material may be used to form each body. In some embodiments the top body 11 and bottom body 12 may be formed from different materials.

The shelter 10 may include additional coatings to further protect the shelter 10 from the environment. For example the shelter 10 may be coated with one or more water and/or humidity-resistant coatings to protect the shelter from degradation over time and to keep occupants dry during inclement weather. In one embodiment, such a coating is non-toxic and water-based, which allows the shelter 10 to be recycled after use. In some embodiments, the shelter may have oil-based and/or wax-based coatings. In some embodiments, the shelter 10 may include materials that have an insulating layer between inner and outer layers of the materials. The insulating layer helps keep the shelter's occupant warm when used in cold weather conditions. Materials that have insulating properties may be used to form the shelter 10.

The shelter 10 may also include one or more flame retardant coatings in addition to or instead of a water resistant or water proof coating(s). The shelter 10 may include multiple layers of different materials. For example, a shelter 10 formed from cardboard may have a thin plastic coating that adheres to the outer surface of a cardboard layer. The plastic coating serves as a waterproof coating while the cardboard provides structural support and rigidity. In some embodiments, the shelter 10 includes printing one of its surfaces (e.g., outside, inside, top, bottom, floor, ceiling, etc.).

The shelters may also include one or more windows. The windows may be formed as openings cut into the top body portion 11 of the shelter. In one embodiment, window units are constructed of clear or transparent material, such as plastic, that is capable of and configured to fold in accordance with the folding pattern of the top body 11. In this manner the window unit does not interfere with or otherwise prevent the shelter from opening (e.g., expanding) and closing (e.g., collapsing). In another embodiment, separate window units are inserted into the top body portion 11 after the shelter 10 has been expanded.

Another embodiment utilizes a quick fold mechanism. For example, such quick fold mechanism may be used with smaller shelters that are designed to accommodate one or two persons, although in some embodiments, the quick fold mechanism is used with larger shelters. The quick fold mechanism is used to quickly and easily collapse the shelter 10 down to the collapsed configuration. For smaller shelters, the quick fold mechanism may be a rope, bungee cord, cable, tether, strap, cord, or other flexible elongate member. The quick fold mechanism is attached to one end of the shelter 10 and extends through the shelter to the opposite end. For example, in one embodiment, one rope is attached to the shelter's back wall on one side of the back wall opening, and a second rope is attached to the shelter's back wall on the opposite side of the back wall opening. The quick fold mechanism extends through the shelter (e.g., through the cavity and/or through one or more zig-zag portions of the top portion 11) to the shelter's opposite end. For example, the ropes can extend through the cavity and through holes in the front end of the shelter, on opposite sides of the cavity opening. When the ropes are pulled with respect to the shelter 10, the shelter's back wall is drawn towards the front wall, and the shelter 10 collapses to its compact configuration. One or more holes may be made in one or more of the outer edges of the top body 11 to form a guide for the quick fold mechanism. The quick fold mechanism can extend through the top body 11 via the guide. In one embodiment, the quick fold mechanism can also be used to keep the shelter in the collapsed state and for transporting the shelter. For example, a lock or clip may be attached to the quick fold mechanism to lock the shelter 10 in the collapsed configuration.

Figure 5:
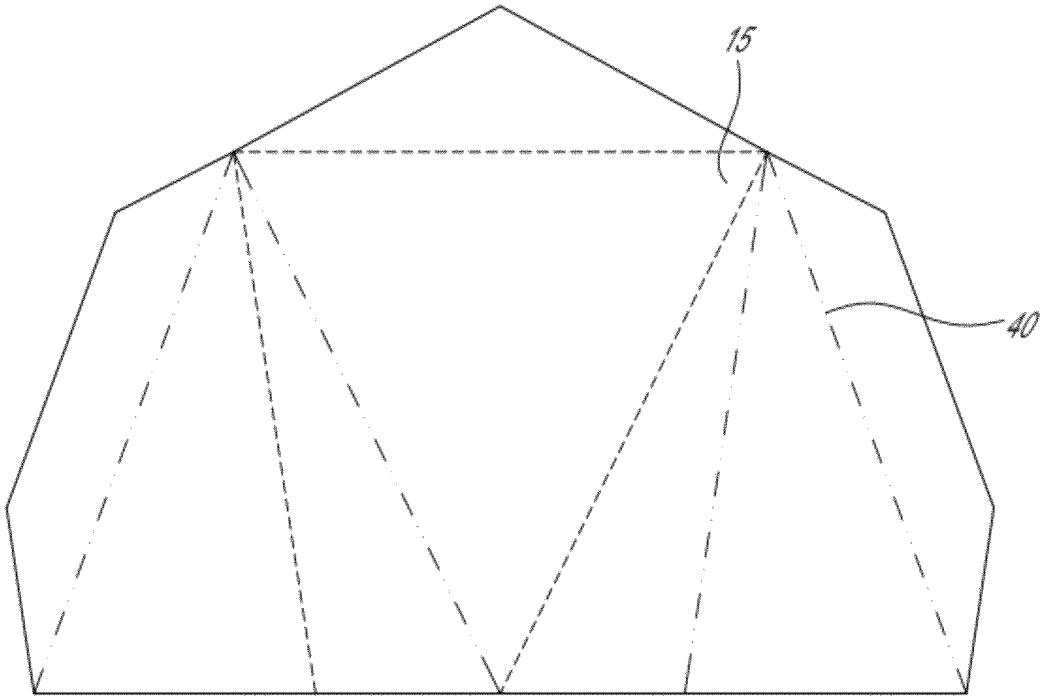
FIG. 5 is an embodiment of an end cover that is compatible with the portable shelter of FIG. 1.
Figure 6:
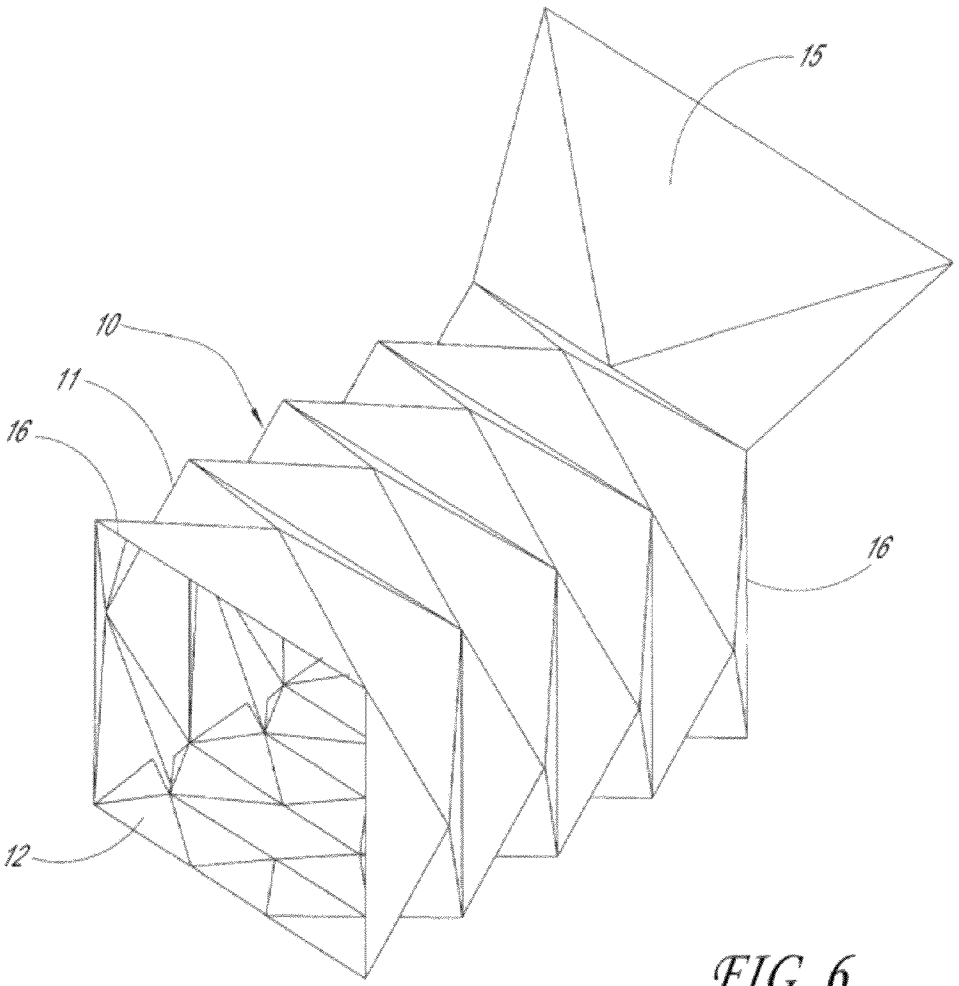
FIG. 6 is another embodiment of a shelter with an end cover.

FIGS. 5 and 6 illustrate an embodiment of an end cover 15 for use with a portable shelter 10. In one embodiment, the end cover 15 is formed from a single sheet of material that is folded according to a predetermined folding pattern 40. The folding pattern 40 includes a multiple peak and valley folds, illustrated as folding lines 26. The end cover 15 is folded and configured in accordance with the folding pattern 40. The end cover 15 is connected to one of the ends 16 of the shelter 10 to cover the corresponding opening of the internal cavity 13. The end cover 15 is coupled to the end 16 in such a manner that the end cover 15 is capable of being folded and unfolded together with the top body 11 and the bottom body 12 of the shelter 10 while serving as a door when the shelter is in the expanded position. The end cover 15 does not impede the movement of the shelter 10 between the first and second positions. In some embodiments, the shelter 10 includes two end covers 15 connected to opposite ends 16, wherein each end cover 15 is arranged to cover an opening of the internal cavity 13. In some embodiments, the bottom body may have end flaps at either end of the shelter that are configured to secure the end cover into a closed position.

Figure 7A:
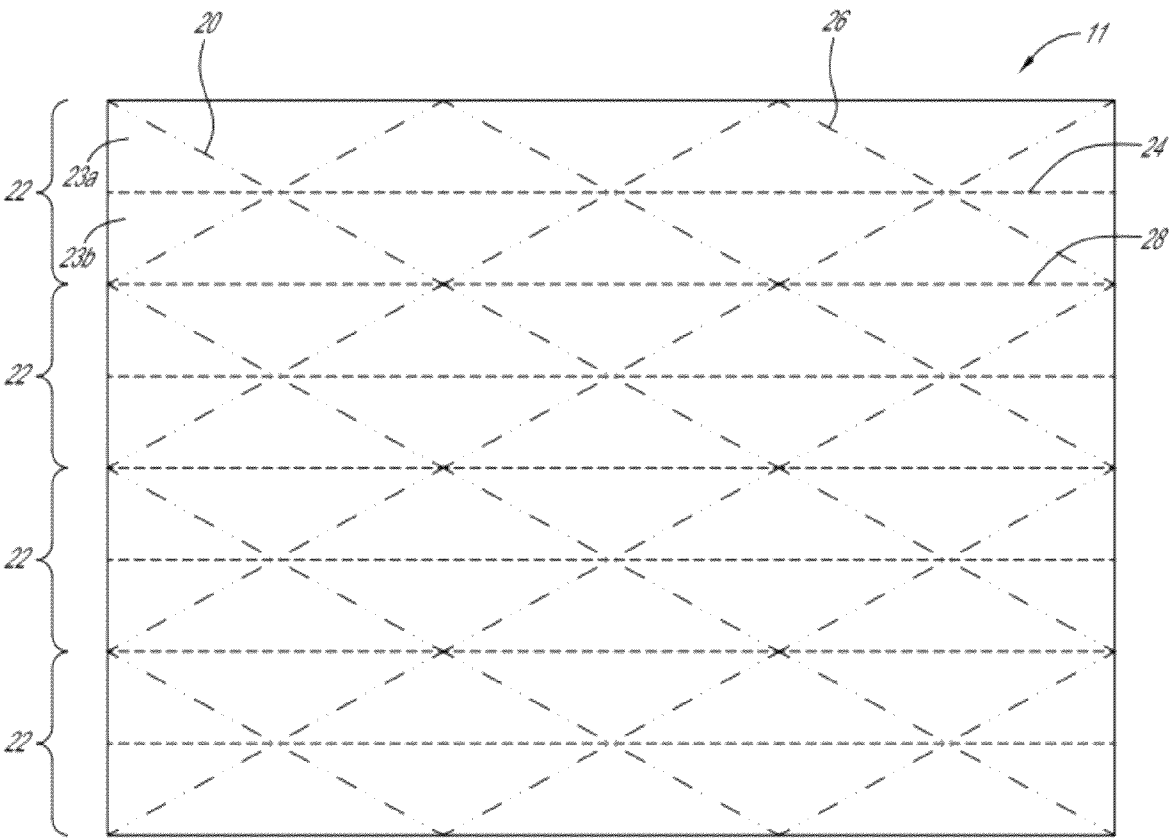
FIGS. 7A and 7B are views of an embodiment of a top body of a portable shelter in an unfolded configuration.
Figure 7B:
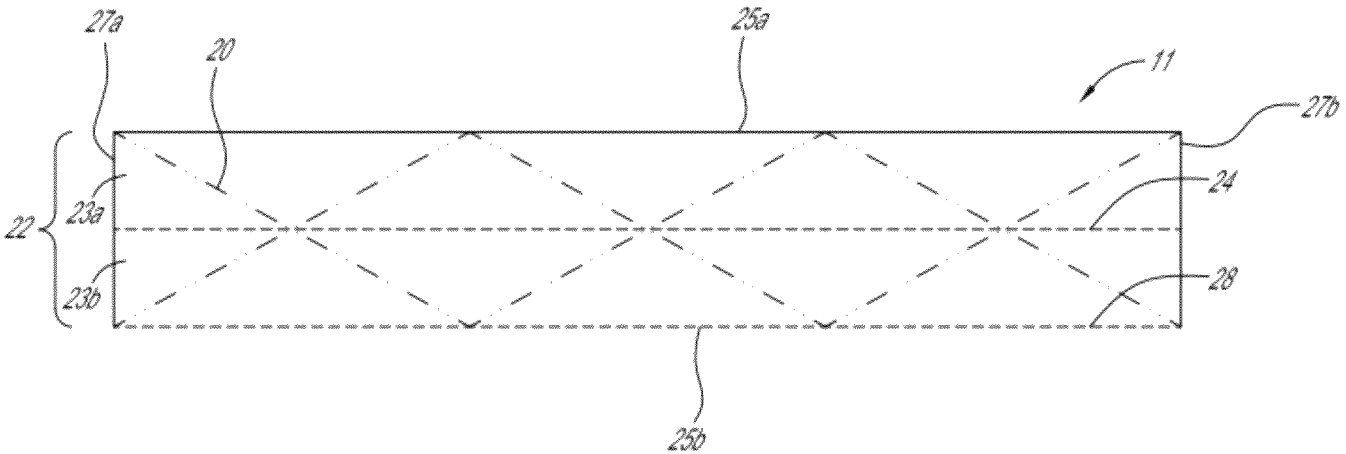
Figure 8B:
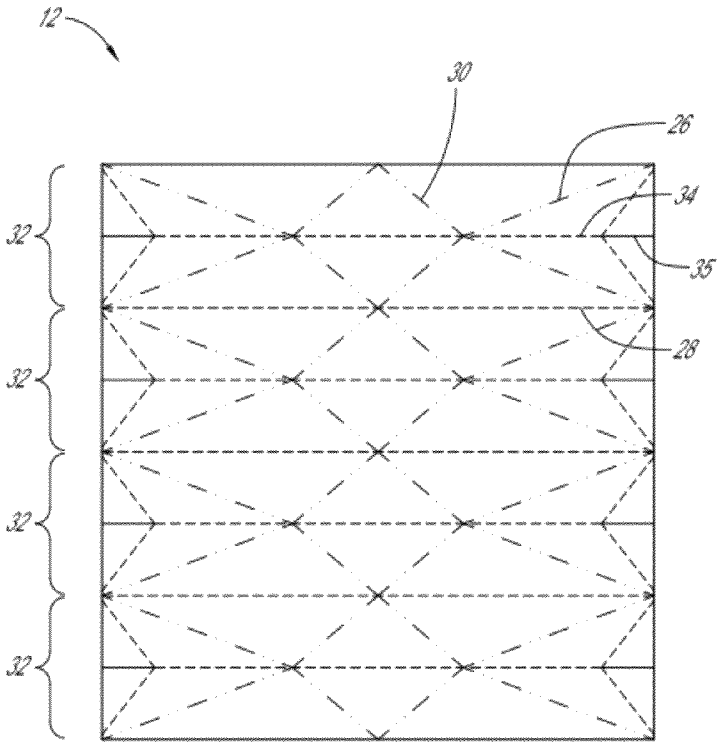
FIGS. 8A, 8B, and 8C are views of an embodiment of a bottom body of a portable shelter in an unfolded configuration.
Figure 8A:
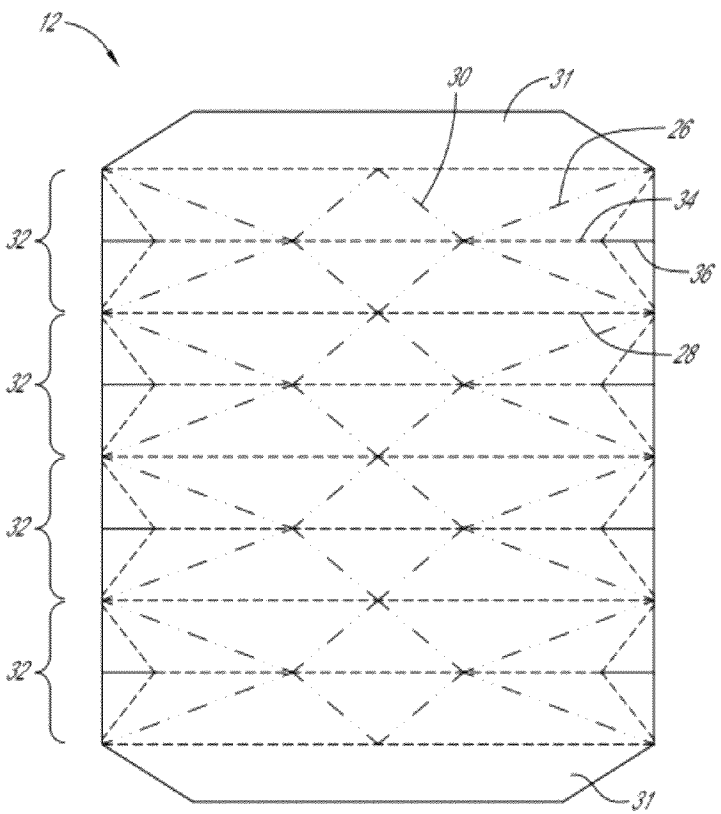
Figure 8C:
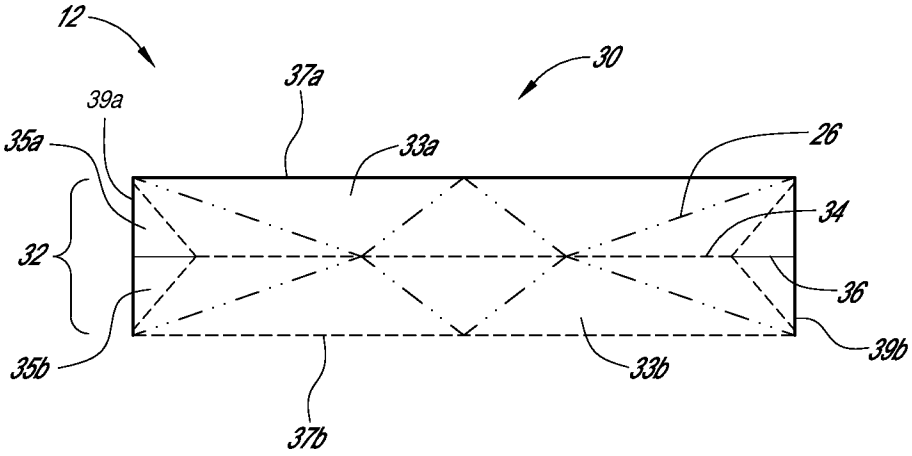

FIGS. 7 and 8 illustrate embodiments of folding patterns that may be used to form to top body 11 and the bottom body 12. To form the top body 11 and the bottom body 12, each body is folded and configured according to the predetermined folding pattern. One embodiment of a folding pattern 20 for the top body 11 is illustrated in FIGS. 7A and 7B. Embodiments of a folding pattern 30 for the bottom body 12 are illustrated in FIGS. 8A through 8C. The folding patterns 20, 30 define several peak and valley folds, which are illustrated as folding lines on the folding pattern 20. The folding pattern generally includes two types of folding lines, valley and mountain (sometimes referred to as "peak") fold lines. In the illustrated folding pattern 20, the dashed lines represent a valley folds and dash-dotted lines represent mountain folds. The folding lines of the folding patterns 20, 30 are configured at a plurality of preset positions arranged for folding in a particular manner so as to form the top body 11 and the bottom body 12. The top body 11 and bottom body 12 are each formed from a substantially flat piece of material.

With specific reference to FIGS. 7A and 7B, the top body folding pattern 20 is a rectangular shape, having two long sides and two short sides. The folding pattern is divided into a plurality of top section units 22. Each top section unit 22 comprises a top section center folding line 24 between a first top section member 23*a* and an adjacently positioned second top section member 23*b*. A plurality of diagonal folding lines 26 provided on each of the section members 23*a-b* of the top section unit 22. The first and second top section members 23*a-b* are symmetrical in construction about the center folding line 24. A plurality of section folding lines 28 divide the top section units 22. The folding pattern 20 is arranged for folding in a predetermined manner to form one top section unit 22 of the top body 11, which is expandable and foldable in construction.

A single top section unit 22 from FIG. 7A is shown in FIG. 7B. In particular, the top section unit 22 has a rectangular shape and two long sides (a first long side 25*a* and a second long side 25*b*) and two short sides (a first short side 27*a* and a second short side 27*b*). Each top section unit 22 is configured such that when folded, the top section unit 22 forms a single arch. Generally, the folding pattern 20 may have any number of top section units 22 that may be positioned adjacent to the first and second long sides 25*a-b* of each top section unit 22.

The folding pattern 20 is provided on the section units 22 with a plurality of diagonal folding lines 26 forming a repeating diamond shaped pattern. The plurality of connecting diagonal folding lines 26 are formed in a zigzag manner longitudinally. The second top section member 23*b* is symmetrical to the corresponding first top section member 23*a* about the center folding line 24. The same folding pattern repeats for each of the of the top section units 22.

FIGS. 8A through 8C illustrate one embodiment of a bottom body folding pattern 30. The bottom body folding pattern 30 is divided into multiple, adjacently-positioned bottom section units 32. Each section unit 32 includes a bottom member folding line 34 that is positioned between two adjacently-positioned bottom section members 33*a-b*. Each section unit 32 also includes a series of longitudinal and zigzag diagonal folding lines 26 provided on each of the section members 33*a-b*. Each bottom section member 33*a-b* has a bottom connecting portion 35*a-b* on either side. Each bottom connecting portion 35*a-b* is substantially triangular and extends from the center line 34 to the diagonal fold line 26. In one embodiment, a cut 36 extends along the center fold line 34 from the outer edge to the diagonal folding line and separates the upper connecting portion 35*a* from the lower connecting portion 35*b*. The upper and lower connecting portions 35*a-b* are configured to bend around the diagonal folding line 26 independent of each other. A plurality of section folding lines 28 divides the bottom section units 32. As shown in FIG. 8A, in some embodiments the bottom body 12 may have bottom end sections 31 that extend beyond the bottom section units 32. The first bottom section member 33*a* and the second bottom section member 33*b* are symmetrical in construction and arranged for folding in a predetermined manner to form one bottom section unit 32 of the bottom body 12 which is expandable and foldable in construction.

FIG. 8C illustrates one embodiment of a single bottom section unit 32. The bottom section unit 32 is a rectangular sheet-like structure having two long sides (first long side 37*a* and second long side 37*b*), and two short sides (first short side 39*a* and second short side 39*b*).

The folding arrangement 30 is provided on the first and second bottom section members 33*a-b* such that the first and second bottom section members 33*a-b* are foldable with respect to each other in a preset manner. In one embodiment, each bottom section member 33*a-b* is evenly divided along the center line 34 to form two symmetrical rectangular section portions. Each of the rectangular section portions is further divided into three triangular portions. In particular, the triangular portion towards the center is smaller in size and hence the diagonal folding line 26 of the triangular portion towards the center is shorter in length than the diagonal folding lines 26 defining the triangular portions on the sides. In other words, the series of connecting diagonal folding lines 26 of unequal length are formed in a zigzag manner longitudinally. Likewise, since the second bottom section member 33*b* is symmetrical to the corresponding first bottom section member 33*a*, the series of connecting diagonal folding lines 26 of unequal length are also formed in a zigzag manner longitudinally along the long sides of the second bottom section member 33*b*.

In some embodiments the bottom body 12 may have a plurality of fold biasing members. The fold biasing members are connected on the bottom side of the bottom body along the plurality of fold lines 26. The valley fold lines 26 illustrated with the dashed lines are configured to fold away from the ground when the shelter is changing from the expanded configuration to the collapsed configuration. However, after the shelter has been used a number of times and the shelter has been moved between the configurations, the original fold lines can fatigue and begin to fold in the opposite direction. The fold biasing members prevent the bottom body 12 from folding in the direction opposite of the fold lines 26. In one embodiment, the fold biasing members include a rigid piece of material, such as plastic, positioned along one edge of the fold line 26. The rigid material of the biasing member prevents the bottom body 12 from folding into the biasing member, thus maintaining the proper direction of the fold. In one embodiment, the biasing member is formed from a material that is rigid or stiff enough to prevent the shelter from folding contrary to the original direction of the fold line 26.

In some embodiments the top body 11 and the bottom body 12 may have relief cutouts. The relief cutouts are configured to reduce stress at high stress locations, such as the intersection of the fold lines. The relief cutouts can include small sections of material that are removed at the intersection points of the folding lines. In one embodiment, the relief cutouts are circular in shape, though other shape cutouts may be utilized. After prolonged use of a shelter, the material may fatigue and fail at fold intersection points. Material failures caused by fatigue at the fold intersection points can cause tearing that propagates along the fold lines, which can eventually lead to failure of the entire structure. The relief cutouts relieve stress at these vulnerable areas and are helpful in preventing large tears along the fold lines. In one embodiment, relief cutouts are provided when the shelter is constructed from a material that is prone to fatigue damage caused by continued folding and unfolding of the shelter, such as cardboard. In embodiments that use relief cutouts, the shelter may be coated with a thin plastic coating to cover the holes and protect the occupant from the environment. The coating is selected to cover the holes and is not subject to fatigue-based failure at the fold line intersections.

Figure 9A:
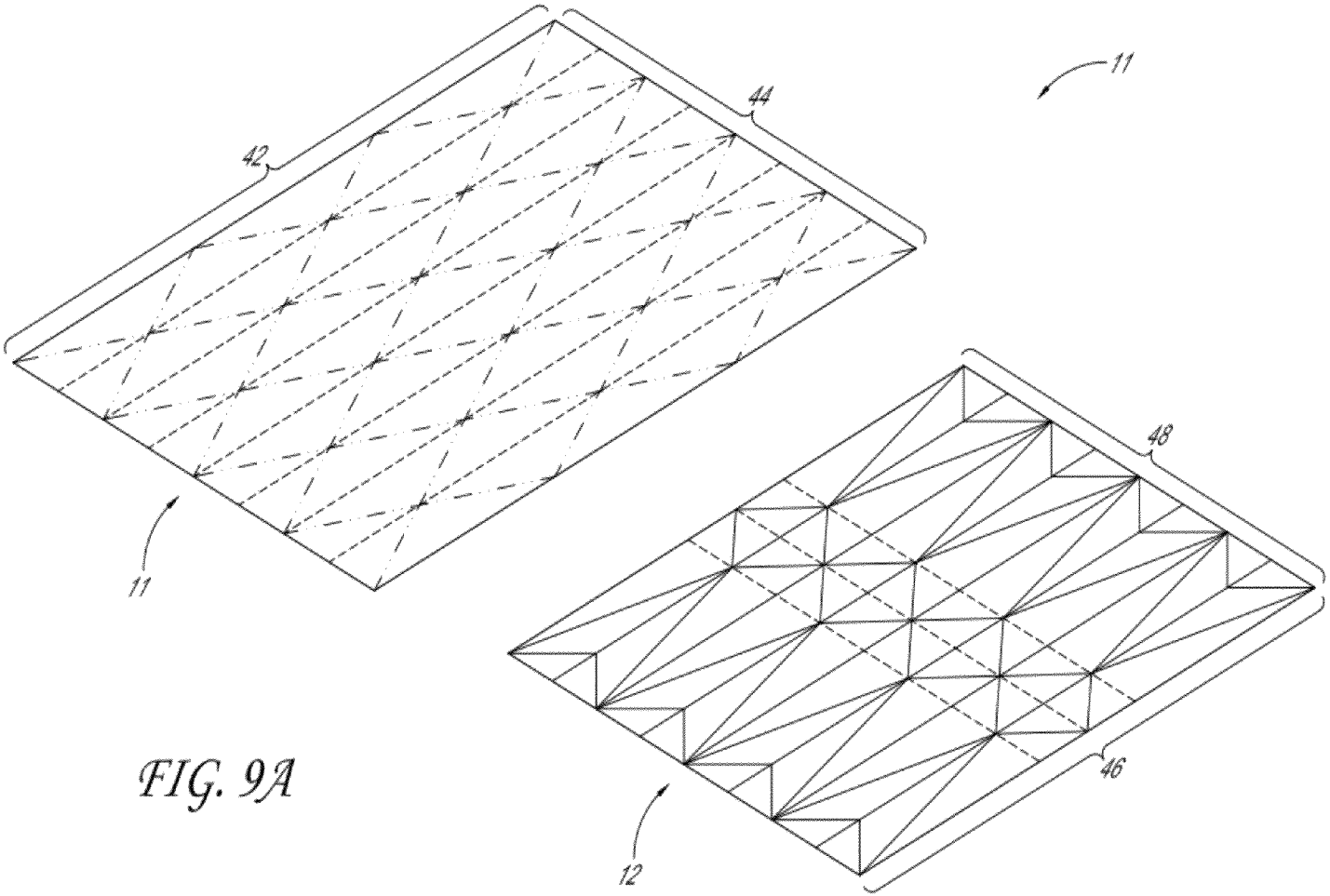
FIGS. 9A and 9B are embodiments of the assembly of a portable shelter.
Figure 9B:
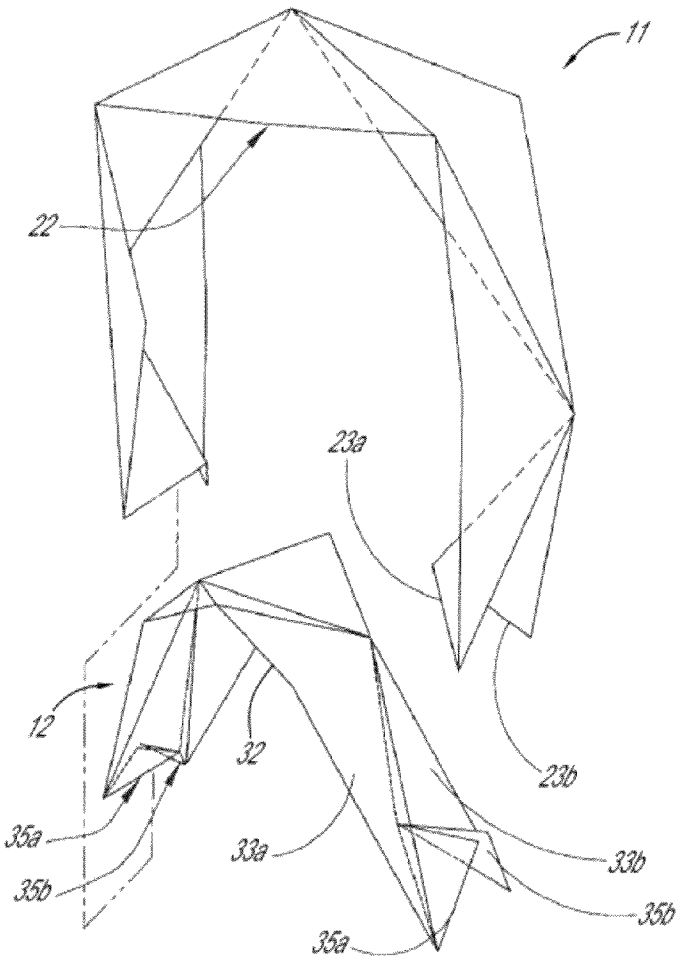

FIGS. 9A and 9B illustrate one embodiment of the assembly of the top body 11 and bottom body 12. The top body 11 includes a series of top section units 22 of which each top section unit 22 consists of two symmetrical top section members 23*a-b*. The bottom body 12 has a corresponding number of bottom section units 32 of which each bottom section unit 32 consists of two symmetrical bottom section members 33*a-b*. Each bottom section member 33 has connecting members 35*a-b* configured to couple to corresponding top section members 23*a-b*. The top body 11 is formed by folding or manipulating the sheet of material in accordance with the folding pattern 20. The bottom body 12 is formed by folding or manipulating the sheet of material in accordance with the folding pattern 30. The length 42 of the top body 11 is greater than the length 46 of the bottom body 12. The width 44 of the top body 11 is greater than the width 48 of the bottom body 12.

With specific reference to FIG. 9B, a single folded top section unit 22 and folded bottom section unit 32 is shown. Each matching pair of top and bottom section units 22, 32 define a shelter section. A series of shelter sections is connected together to form a portable shelter 10. The plurality of shelter sections which form the shelter 10 are foldable and expandable. The top body 11 and bottom body 12 in FIG. 9A illustrate an embodiment of the shelter with four matching pairs.

In particular, the top section unit 22 and the bottom section unit 32 are connected by coupling the bottom connecting portions 35*a-b* to the corresponding top section members 23*a-b*. The upper bottom connecting portion 35*a* couples to the top section member 23*a*. The lower bottom connecting portion 35*b* couples to the top section member 23*b*. In one embodiment, the two connecting portions 35*a-b* are flipped to transversely extend from the corresponding bottom section member 33*a-b* for bonding to the corresponding top section member 23*a-b*. In other words, the two connecting portions 35*a-b*, are provided between the first and the second bottom section members 33*a-b*, which provide a transversely extended connecting portion 35*a-b* to bond to the top section unit 22. The same procedure is followed for each corresponding pair of top and bottom sections 23*a-b*, 33*a-b*. The units may be coupled together using hook and loop fasteners, button fasteners, glue and tape adhesives or other suitable means of coupling the units together that provides a sufficient bond between the top and bottom units 22, 32. The top section unit 22 and the bottom section unit 32 are coupled such that the top section unit 22 and the bottom section unit 32 are connected to form a one-piece structure capable of being opened to an unfolded position or closed to a folded position.

The top section units 22 and bottom section units 32 are shown in FIGS. 9A and 9B as exemplary embodiment only. The shelter 10 can be formed by any number of top and bottom section units 22, 32. In some embodiments a shelter 10 may be manufactured with a series of ten or fifteen top section units 22 and bottom section units 32.

When coupled together, each of the top section units 22 and each of the bottom section units 32 are overlapped with each other respectively at the folded position. Each of the zigzag diagonal folding lines 26, which are longitudinally provided along the corresponding section member 33*a-b* of the top section unit 22 are equal in length. Each of the zigzag diagonal folding lines 26, which are longitudinally provided along the corresponding section member 33*a-b* of the bottom section unit 32 are unequal in length such that at the folded position, the bottom section unit 32 is surrounded by the top section unit 22.

The portable shelter 10 may be manufactured by using the following process. The process includes (a) providing a rectangular sheet of top body materials to define a series of top section unit 22 and defining two symmetrical top section members 23*a*, 23*b* of equal size for each of the top section units 22; (b) providing a rectangular sheet of bottom body materials to define a series of bottom section unit 32 and defining two symmetrical bottom section members 33*a*, 33*b* of equal size for each bottom section unit 32, (c) creating (e.g., by engraving, scoring, pre-folding, creasing, etc.) a top section folding line 24 between the two top section members 23*a*, 23*b* for each top section unit 22; (d) creating a bottom section folding line 34 between the two bottom section members 33*a*, 33*b* for each of the bottom section unit 32; (e) creating a plurality of folding lines 26 onto the top section units 22 and the bottom section units 32 at a plurality of preset positions; (f) defining two connecting portions 35 on each end of the of the bottom section unit 32 by cutting along the folding line 34 at the two proximal ends of the bottom section unit 32; (g) connecting the series of the bottom section unit 32 to the series of the top section unit 22 through the two connecting portions 35 on each end of the bottom section unit 32; (h) forming the shelter to define a shelter cavity 13 when in an expanded position; and (i) folding along section folding lines 28 and the folding lines 26 in such a manner that the bottom section unit 32 is surrounded by the top section unit 22, wherein the top and bottom section units 22, 32 are positioned in an overlapped manner when in the folded position.

Figure 10:
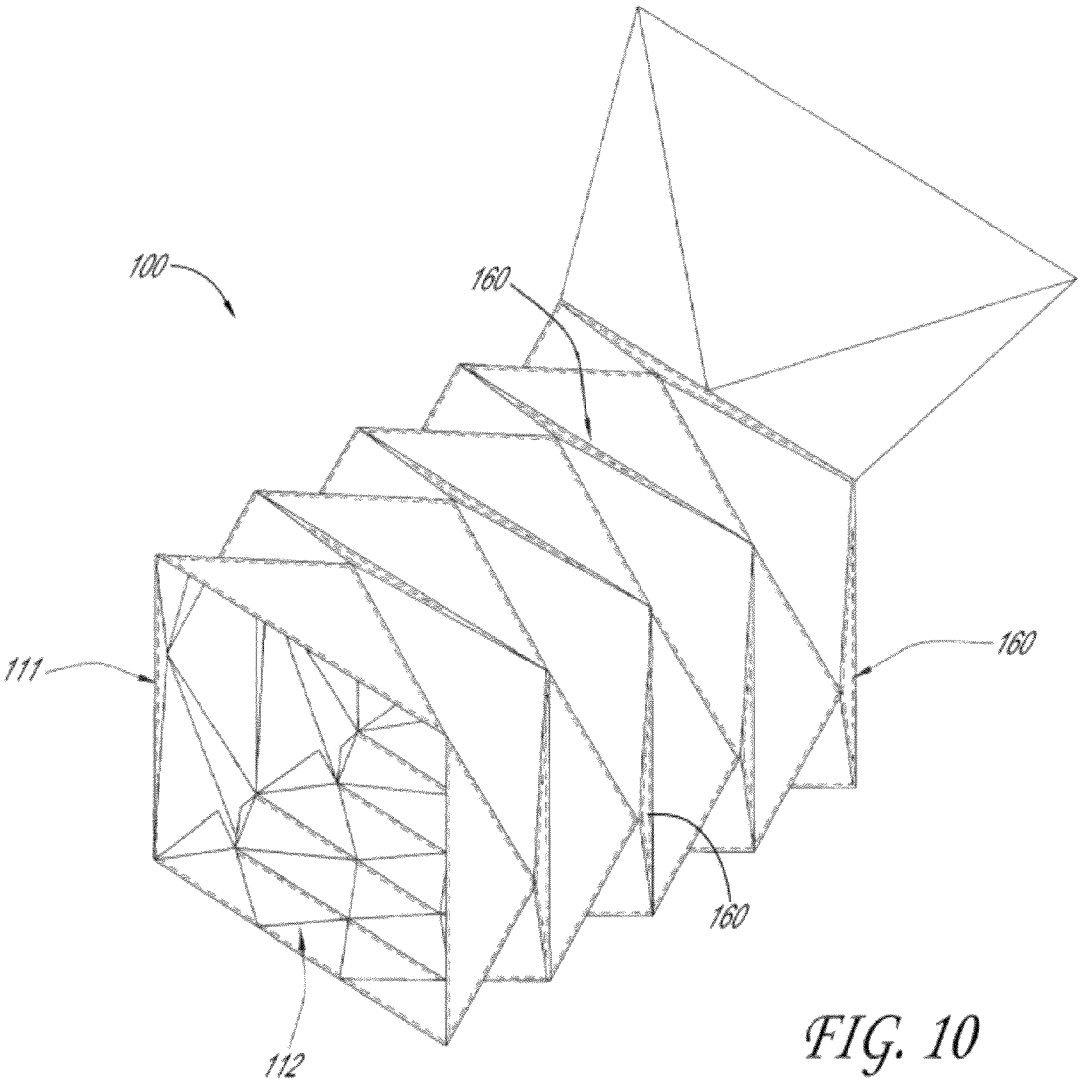
FIG. 10 is yet another embodiment of a portable shelter.

FIG. 10 illustrates another embodiment of a portable shelter 100. In this embodiment, a plurality of reinforcing members 160 are provided at the folding lines for supporting the shelter structure. When the structure is large, the rigidity of the material may not be sufficient to support the weight of the structure without additional support. As such, reinforcing members 160 are provided in the top body 111 and the bottom body 112 to provide sufficient support to the shelter 100. The reinforcing members 160 are placed in the bottom body 112 so that the bottom body 112 can maintain a form that is substantially flat when the structure 100 is in an expanded configuration. The reinforcing members may be formed from struts, tubing, or other structures that are configured to fold with the shelter 100 along the fold lines. Metal, plastic and other materials that provide sufficient strength to the shelter may be used to form the reinforcing members 160. The cross-sectional shape of the reinforcing members 160 is not limited to a specific shape. The reinforcing members are designed such that they do not substantially impede the movement of the shelter 100 between the expanded and collapsed configurations.

Figure 11:
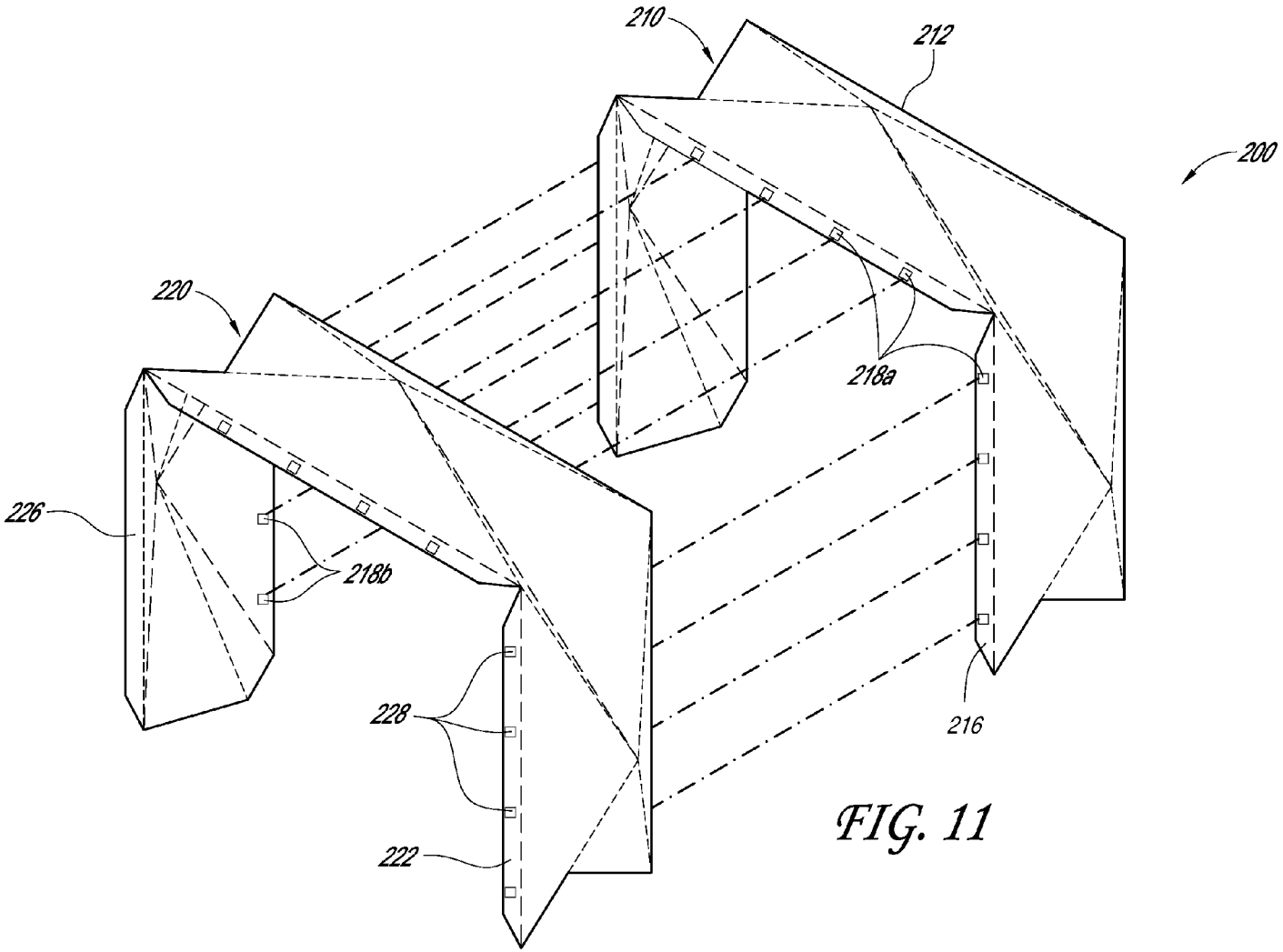
FIG. 11 is another embodiment of the assembly of a portable shelter.

FIG. 11 illustrates another embodiment of the shelter assembly 200. This embodiment of the shelter assembly includes a first section unit 210 and a second section unit 220. The first section unit comprises a first top body 212 and a first plurality of end flaps 216. Each end flap 216 has a plurality of coupling members 218*a*. The second section unit comprises a second top body 222 and a second plurality of end flaps 226. The second top body 222 has a first plurality of coupling members 218*b* that correspond to the first plurality of coupling members 218*a*. The second plurality of end flaps 226 has a second plurality of coupling members 228. In one embodiment, the coupling members are hook and loop fasteners. Other types of coupling members may also be used to couple each top section together. The first and second section units are formed in accordance with the embodiments described in FIGS. 7A and 7B.

The first section unit 210 and the second section unit 220 are coupled together by engaging the plurality of coupling members on the first section unit 218*a* and the corresponding plurality of coupling members on the second section unit 218*b*. The end flaps and coupling members are configured such that when the first section unit 210 and the section unit 220 are coupled together both of them function as a single unit. The completed shelter assembly expands and contracts following the same principles discussed in accordance with FIGS. 1 through 4.

Single sections may be coupled together to form shelters of custom sizes. In some circumstances, multiple pieces of material are used to form a single section. This method of connecting section members together may also be used with shelter assemblies that have more than one unit section per assembly. This method may be used to create many different size shelter assemblies that are not limited to a single sheet of material.

Figure 12C:
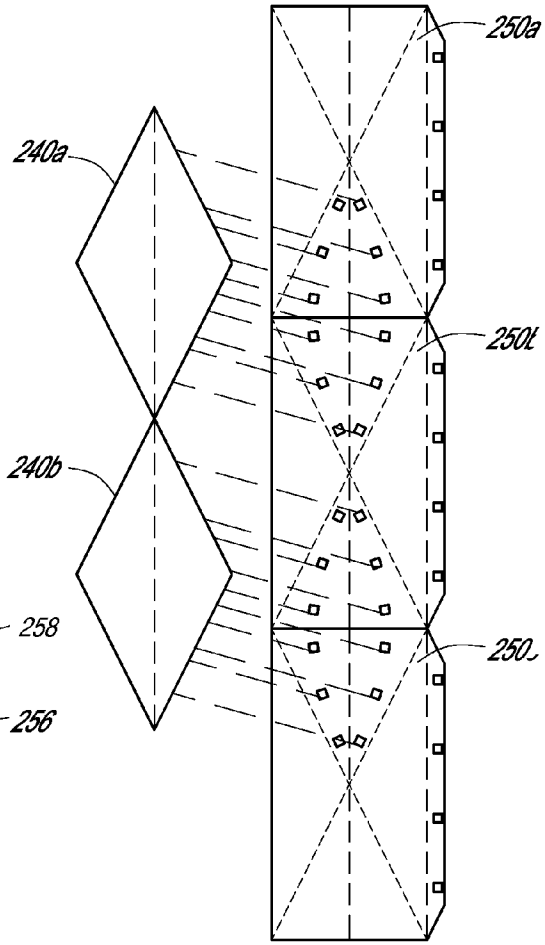
FIGS. 12A, 12B, and 12C illustrate a method of constructing an embodiment of a top portion of a portable shelter.
Figure 12B:
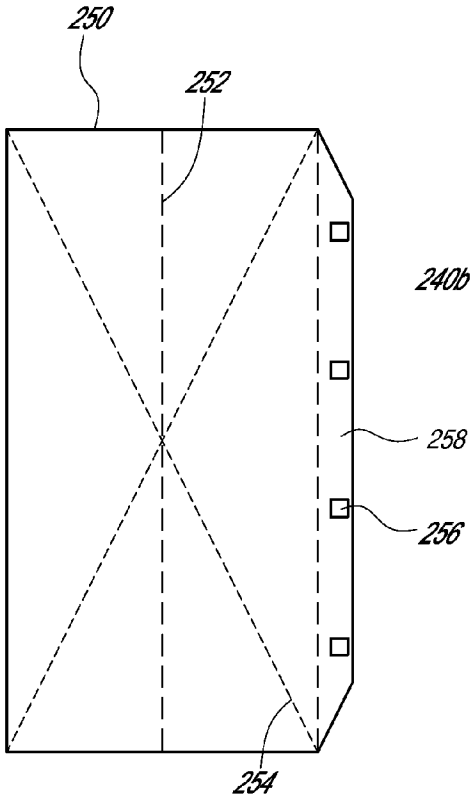
Figure 12A:
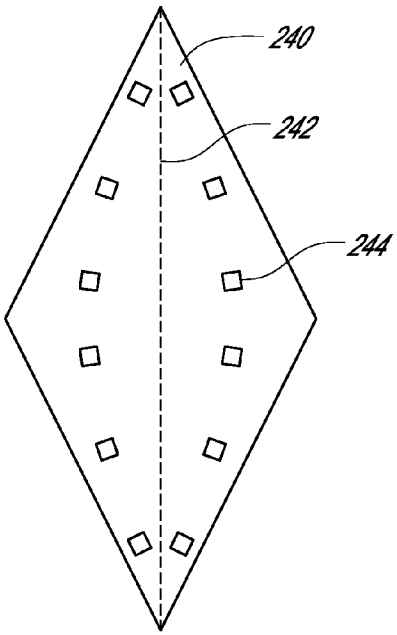

FIGS. 12A through 12C illustrate a method for constructing a top section unit from a plurality of pieces of material. FIG. 12A illustrates a diamond shaped section 240 comprising a plurality of coupling members 244 and a center fold line 242. FIG. 12B illustrates a rectangular shaped section 250 having a plurality of coupling members 256 along a tab 258, a center line 252, and a plurality of fold lines 254. FIG. 12C illustrates how the diamond sections 240 and the rectangular sections 250 are coupled together to create a top section unit. In this embodiment three rectangular sections 250*a-c* are aligned end to end and two diamond shaped sections 240*a-b* are aligned such that the diamond section coupling members 244 are aligned with the rectangular section coupling members 256. Each diamond section 240 is coupled to two rectangular sections 250. In this embodiment the diamond sections 240 are not coupled together. The diamond sections 240 and the rectangular sections 250 are coupled such that the center fold line 242 of the diamond section 240 aligns with the center fold line 252 of the rectangular section 250 and the perimeter of the diamond section 240 substantially aligns with the diagonal fold lines 254 of the rectangular section 250. After the diamond sections 240 and the rectangular sections 250 are coupled together they function as a single top section unit as described in connection with FIG. 11. The coupling members may be hook and loop fasteners, button fasteners, adhesive tapes, adhesive glues, or other appropriate coupling materials.

Figure 13A:
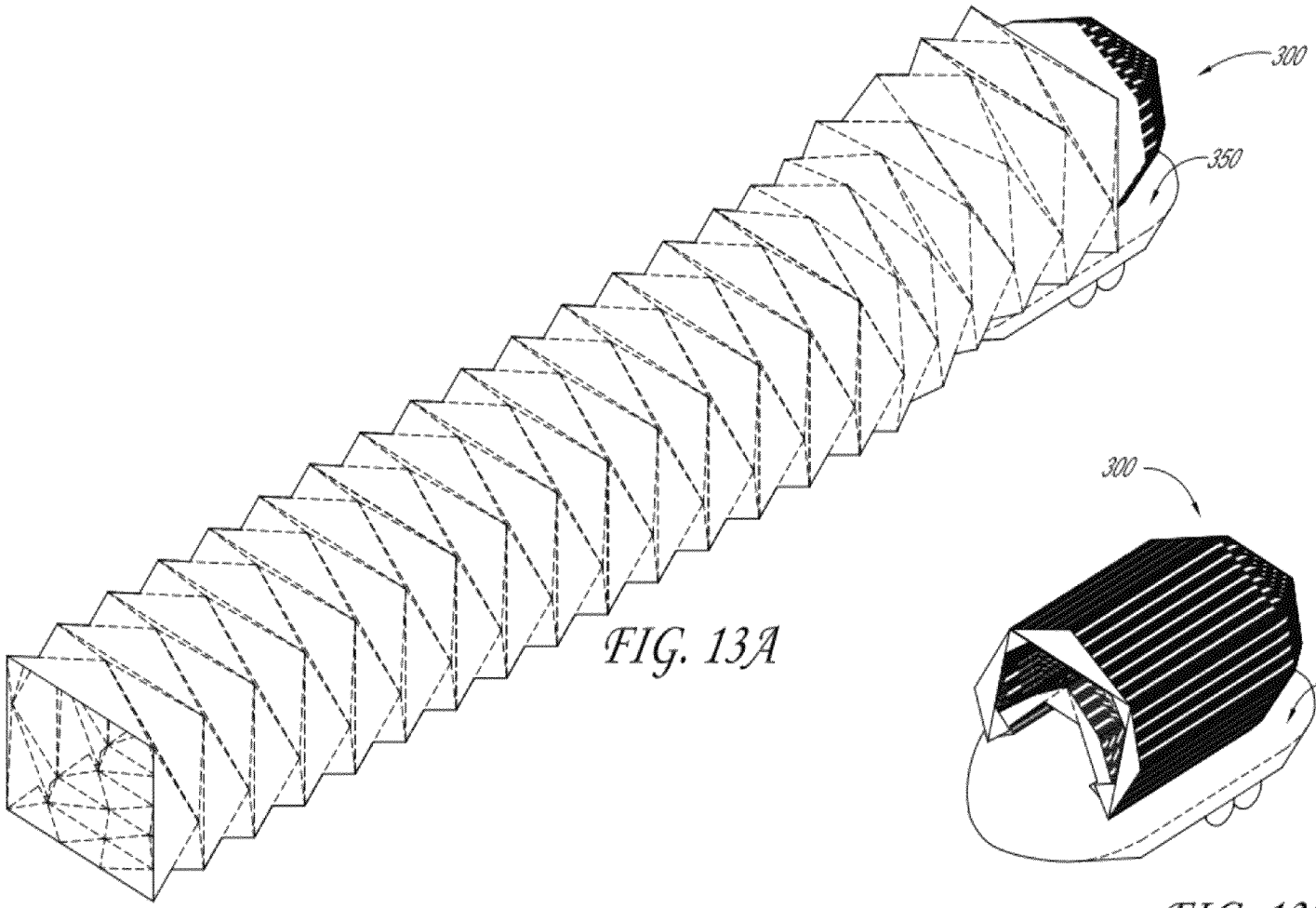
FIGS. 13A and 13B are yet another embodiment of a portable shelter.
Figure 13B:
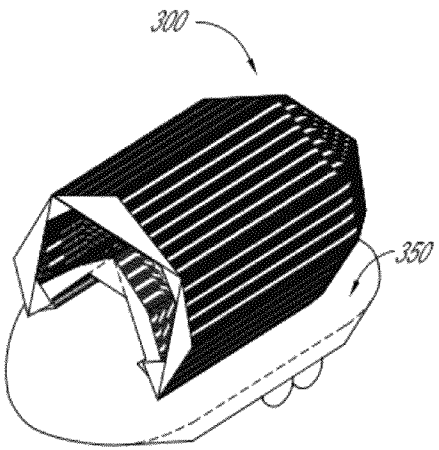

An example of a large shelter assembly is illustrated in FIGS. 13A and 13B. This embodiment of the shelter assembly 300 is mounted on a trailer 350. FIG. 13A illustrates the shelter assembly 300 in an expanded configuration. FIG. 13B illustrates the shelter assembly 300 in the collapsed storage configuration on the trailer 350. In this embodiment the shelter assembly 300 would expand off of the trailer. The shelter assembly 300 may be expanded by securing a first end of the assembly to the ground and moving the trailer in the opposite direction until the shelter 300 has expanded to its full length as illustrated in FIG. 13A. This type of shelter assembly may be used in a disaster relief situation where significantly large shelters would be needed to accommodate large numbers of people and other disaster relief facilities. The shelter assembly may include reinforcing members as discussed above in association with FIG. 10.

The teachings in this disclosure for the shelter may be designed and/or used for a variety of purposes, including non-shelter purposes. For example, the folding configurations could be used to form crates, cartons, boxes, or other types of containers. In some embodiments the containers could be water resistant and/or flame-retardant, for use in transporting flammable containers. The assemblies could be used as portable display units or booths. In some embodiments larger assemblies could be used as collapsible storage units or semi-permanent shelters. Larger assemblies could be formed from plastic or other heavy duty materials.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. And it is to be understood that yet further structures in addition to the examples discussed herein can be employed in accordance with principles discussed herein. For example, shelters employing slightly different folding patterns than the preferred embodiment. Including folding patterns for large structures may be modified to accommodate a support structure. In a further preferred embodiment the portable shelter may utilize different folding patterns to modify the external shape of the shelter.

Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A portable shelter configured for use as a temporary shelter, such as during disaster situations, comprising:

an elongate body having a first and a second body portion, the first body portion forming walls and a roof of the portable shelter and comprising a first plurality of triangular planar faces, the first body portion configured to be folded according to a first folding pattern, the first folding pattern defining the first plurality of triangular planar faces, the second body portion forming a floor of the portable shelter and comprising a second plurality of triangular planar faces, the second body portion configured to be folded according to a second folding pattern, the second folding pattern defining the second plurality of triangular planar faces, wherein the second folding pattern that is different than the first folding pattern;

the elongate body being collapsible and expandable between a first, expanded configuration and a second, collapsed configuration, the elongate body having a longitudinal length extending from a first end of the elongate body to a second end of the elongate body;

wherein in the first, expanded configuration the second body is substantially flat along the longitudinal length;

wherein the first and second folding patterns are configured such that in the first, expanded configuration the first and second body portions form a trapezoidal opening to an interior of the portable shelter;

wherein a bottom edge of the opening is formed by the second body portion and a length of the bottom edge of the opening is greater than a length of a top edge of the opening; and wherein in the second, collapsed configuration the first body defines a c-shaped cavity and the second body is folded and compressed along the longitudinal length such that the second body extends into the c-shaped cavity.

2. The portable shelter of claim 1, wherein the first and second body portions are removably attached to each other.

3. The portable shelter of claim 1, wherein the first body portion further comprises a first plurality of connecting members and the second body portion further comprises a second plurality of connecting members coupled to the first plurality of connecting members.

4. The portable shelter of claim 1 further comprising a plurality of structural support members coupled to the first body portion.

5. The portable shelter of claim 1, wherein the first and second body portions are formed from separate pieces of material.

6. The portable shelter of claim 5, wherein the first body portion is formed from a first material and the second body portion is formed from a second material that is different from the first material.

7. The portable shelter of claim 1, wherein the elongate body further comprises a substantially waterproof coating.

8. The portable shelter of claim 7, wherein the substantially waterproof coating is provided on an outer surface of the first body portion, the second body portion, or both.

9. The portable shelter of claim 1, wherein the elongate body further comprises a substantially fireproof coating.

10. The portable shelter of claim 9, wherein the substantially fireproof coating is provided on an inner surface of the first body portion, the second body portion, or both.

11. The portable shelter of claim 1, further comprising a third body portion having a third folding pattern and coupled to the elongate body that is configured to cover a first opening of the cavity.

12. A portable shelter configured for use as a temporary shelter, such as during disaster situations, comprising:

an elongate body having a first and a second body portion, the first body portion forming walls and a roof of the portable shelter and comprising a first plurality of triangular planar faces, the first body portion configured to be folded according to a first folding pattern, the first folding pattern defining the first plurality of triangular planar faces, the second body portion forming a floor of the portable shelter and comprising a second plurality of triangular planar faces, the second body portion configured to be folded according to a second folding pattern, the second folding pattern defining the second plurality of triangular planar faces, wherein the second folding pattern that is different than the first folding pattern;

the elongate body being collapsible and expandable between a first, expanded configuration and a second, collapsed configuration, the elongate body having a longitudinal length extending from a first end of the elongate body to a second end of the elongate body;

wherein in the first, expanded configuration the second body is substantially flat along the longitudinal length and the first body defines a c-shaped cavity that extends along the longitudinal length;

wherein the first and second folding patterns are configured such that in the first, expanded configuration the first and second body portions form a trapezoidal opening to an interior of the portable shelter;

wherein a bottom edge of the opening is formed by the second body portion and a length of the bottom edge of the opening is greater than a length of a top edge of the opening; and wherein in the second, collapsed configuration the first plurality of triangular planar faces are substantially parallel to each other and the second plurality of triangular planar faces.

13. The portable shelter of claim 12, wherein the first body portion and the second body portion are formed from different materials.

14. The portable shelter of claim 12, wherein the elongate body is formed from cardboard.

15. The portable shelter of claim 12, wherein the volume of the cavity is substantially larger in the first configuration than in the second configuration.

* * * * *

UNITED STATES PATENT AND TRADEMARK OFFICE

CERTIFICATE OF CORRECTION

PATENT NO. : 8,820,005 B2
APPLICATION NO. : 13/475826
DATED : September 2, 2014
INVENTOR(S) : Hovsepian It is certified that error appears in the above-identified patent and that said Letters Patent is hereby corrected as shown below:

In the Claims

Column 12 line 40, Claim 1, after “pattern” delete “that”.

Column 14 line 4, Claim 12, after “pattern” delete “that”.

Signed and Sealed this
Sixteenth Day of June, 2015

Michelle K. Lee

Michelle K. Lee
*Director of the United States Patent and Trademark Office*